US007314136B2

(12) United States Patent
Stefandl

(10) Patent No.: US 7,314,136 B2
(45) Date of Patent: Jan. 1, 2008

(54) INTERLEAVABLE FLUID BEVERAGE CONTAINER

(75) Inventor: Roland E. Stefandl, Princeton, NJ (US)

(73) Assignee: Super Chill Beverage Croup Inc., Princeton, NJ (US)

( * ) Notice: Subject to any disclaimer, the term of this patent is extended or adjusted under 35 U.S.C. 154(b) by 23 days.

(21) Appl. No.: 10/445,470

(22) Filed: May 27, 2003

(65) Prior Publication Data

US 2004/0238550 A1 Dec. 2, 2004

(51) Int. Cl.
*B65D 21/00* (2006.01)
*B65D 85/62* (2006.01)

(52) U.S. Cl. ..... 206/504; 206/503; 220/710

(58) Field of Classification Search ..... 220/710, 220/DIG. 13, 23.6; 206/503, 504, 506; 229/103.1
See application file for complete search history.

(56) References Cited

U.S. PATENT DOCUMENTS

| | | | | | |
|---|---|---|---|---|---|
| 2,942,760 | A | | 6/1960 | Schneider | |
| 3,347,401 | A | * | 10/1967 | Nataf | 215/389 |
| 3,356,244 | A | | 12/1967 | Witchell | |
| 3,486,679 | A | * | 12/1969 | Pfahler | 229/103.1 |
| 4,016,995 | A | | 4/1977 | Frazer | |
| D272,602 | S | * | 2/1984 | Gregory | D9/522 |
| 4,898,306 | A | * | 2/1990 | Pardes | 222/206 |
| 5,121,859 | A | * | 6/1992 | Stull | 222/153.06 |
| 5,188,250 | A | | 2/1993 | Kovacic et al. | |
| 5,295,609 | A | * | 3/1994 | Robbins, III | 220/710 |
| 5,485,920 | A | * | 1/1996 | Fritz | 206/509 |
| D369,978 | S | | 5/1996 | Mohamed | |
| 5,597,089 | A | * | 1/1997 | Smith | 220/710 |
| D386,072 | S | | 11/1997 | Sahatjian | |

FOREIGN PATENT DOCUMENTS

| | | |
|---|---|---|
| FR | 1.182.399 | 6/1959 |

* cited by examiner

*Primary Examiner*—Anthony D. Stashick
*Assistant Examiner*—Harry A Grosso
(74) *Attorney, Agent, or Firm*—Synnestvedt & Lechner LLP

(57) ABSTRACT

A fluid container having a generally tetrahedral shape configured for interleaved packaging, and having a conduit with a seal at one end. The container is formed from either a rigid material, such as a blow-molded polymer, or a semi-rigid material, including pliant sheet material in one or more plies. It may include a recess in its base to improve container rigidity and stability. The seal at one end of the conduit can be either a fitment, or a frangible closure, and may include a tab to facilitate opening. Also, a multi-pack of items and a method for assembling a multi-pack of items for the efficient use of shelf space. A first plurality of generally tetrahedral items is arranged in a hexagonal footprint, and is interleaved with a second plurality of similarly arranged tetrahedral items. A small void space within the resulting multi-pack may be optionally used to carry another object.

10 Claims, 5 Drawing Sheets

INTERLEAVABLE FLUID BEVERAGE CONTAINER

BACKGROUND OF THE INVENTION

1. Field of Invention

The invention is related generally to the field of packaging, and more particularly, to a fluid beverage container configured for interleaved packing.

2. Description of Related Art

In the field of retail sales, a concern for merchants is the efficient use of finite and relatively scarce shelf space. Products that are packaged with improved space efficiency allow a retailer to offer greater variety of items in a given space, and/or to stock and display more quantity, either of which can improve sales volume.

Specifically among soft-drink beverages, one popular product is sold under the CAPRI SUN® brand. This product is packaged in a pouch generally rectangular in height and width, having a wide bottom that tapers in depth to a narrow top. Multi-pack units are sold having several pouches, these being boxed together in an upright orientation. The area required for the base of the box is defined by the footprint of the designated number of filled pouches. However, such a box still has a considerable void space due to the overall geometry of the filled pouch, and can therefore be improved.

Additionally with such beverage pouches, the problem arises of how to open the pouch, and thereafter drink the beverage. One common solution is to provide a wrapped straw with each beverage pouch, secured to the outside thereof. These straws are generally rigid, and are cut to have a point at one end. Some predetermined and appropriately designated weak point of the pouch is punctured with the sharpened point of the straw, allowing consumption of the beverage.

This arrangement has certain drawbacks. For example, the straw may become separated from the pouch prior to its intended use. For reasons of durability and preservation of the contents, so called barrier properties, such pouches are typically resilient, and difficult to tear open by hand. In that case, the package could only be opened with great force, likely spilling the contents in the process. Therefore, it would be inconvenient to consume the beverage if the straw were separated.

Even if not separated, the wrapper of the straw may become damaged, compromising its hygiene and that of the beverage when the straw is inserted into the pouch.

BRIEF SUMMARY OF THE INVENTION

To overcome these and other difficulties in the prior art, disclosed is a fluid container having a shape configured for interleaved packaging, and having a drinking or dispensing conduit with a seal at one end.

The container is formed from either a rigid material, such as a blow-molded polymer, or a semi-rigid material, including pliant sheet material in one or more plies. In either case, it may include a recess in its base to improve container rigidity and stability. The seal at one end of the conduit can be either a fitment, or a frangible closure, and may include a tab to facilitate opening.

The invention also discloses multi-pack of interleavable items and a method for assembling a multi-pack of items for the efficient use of shelf space. A first plurality of generally tetrahedral items is arranged in a hexagonal footprint, and is interleaved with a second plurality of similarly arranged tetrahedral items. A small void space within the resulting multi-pack may be optionally used to carry another object.

BRIEF DESCRIPTION OF THE DRAWINGS

These and other features and advantages will become apparent from the following descriptions and drawings, where like numerals designate like features across the several figures.

DETAILED DESCRIPTION OF THE INVENTION

Figure 1:
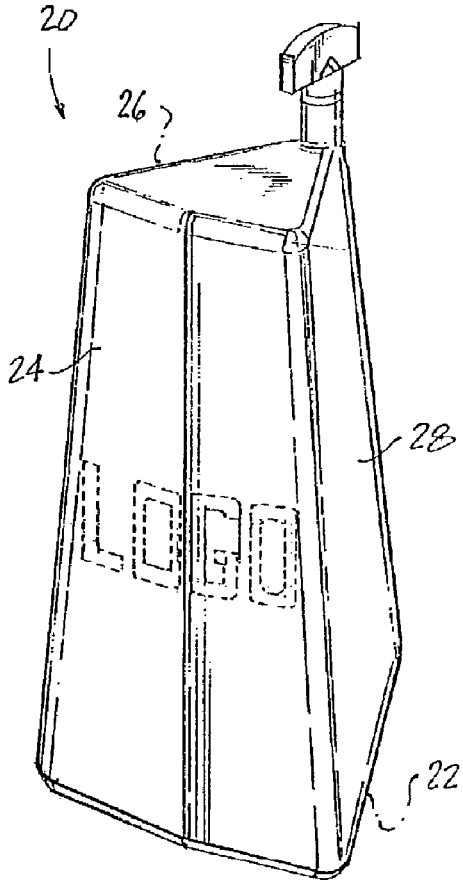
FIG. 1 is a perspective view of a single container according to an exemplary embodiment of the present invention.
Figure 2:
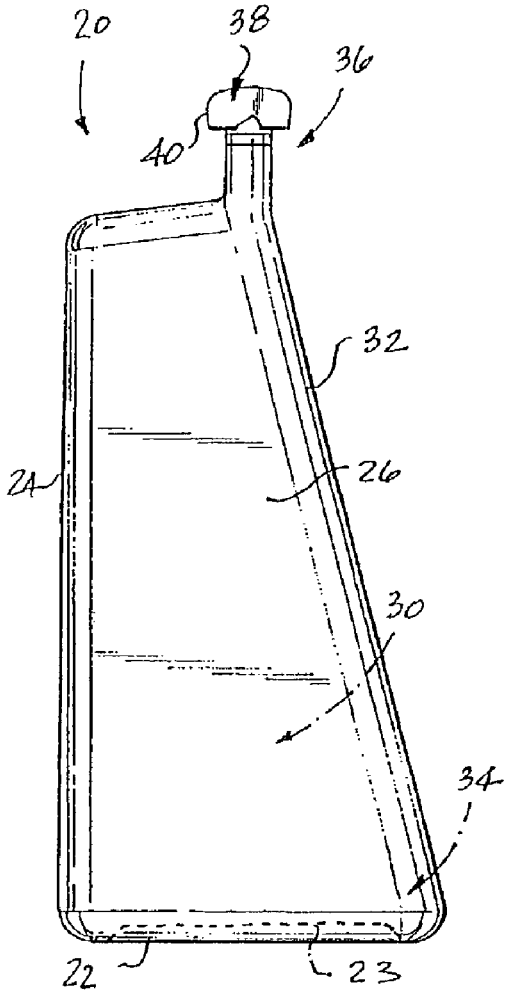
FIG. 2 is a side elevation view of a single container according to an exemplary embodiment of the present invention.
Figure 3:
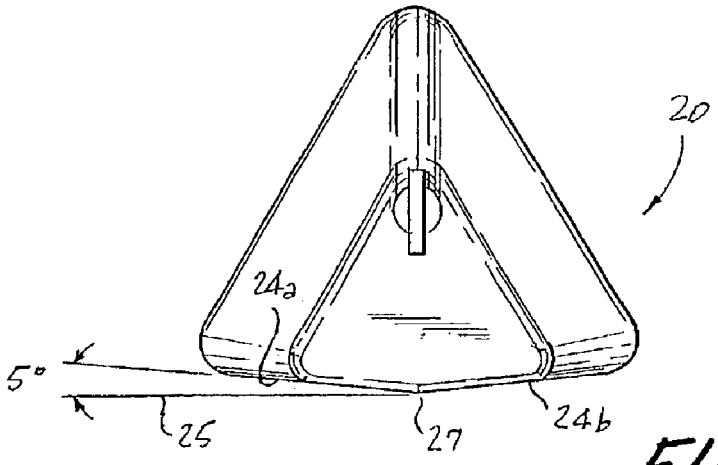
FIG. 3 is a plan view of a single container according to an exemplary embodiment of the present invention.

Referring now to FIGS. 1-3, an exemplary embodiment of the container, generally 20, is shown. The container 20 shown has a generally tetrahedral shape, though other shapes are possible within the scope of the invention. Container 20 as illustrated has in this case a generally triangular base 22, and walls 24, 26, 28 extending upward from said base 22. Base 22 may be formed with a recess 23, which can add rigidity to the walls 24, 26, 28, and also increase the overall stability of the container 20, by holding the bulk of the container 20 off the surface on which it is standing.

Figure 4:
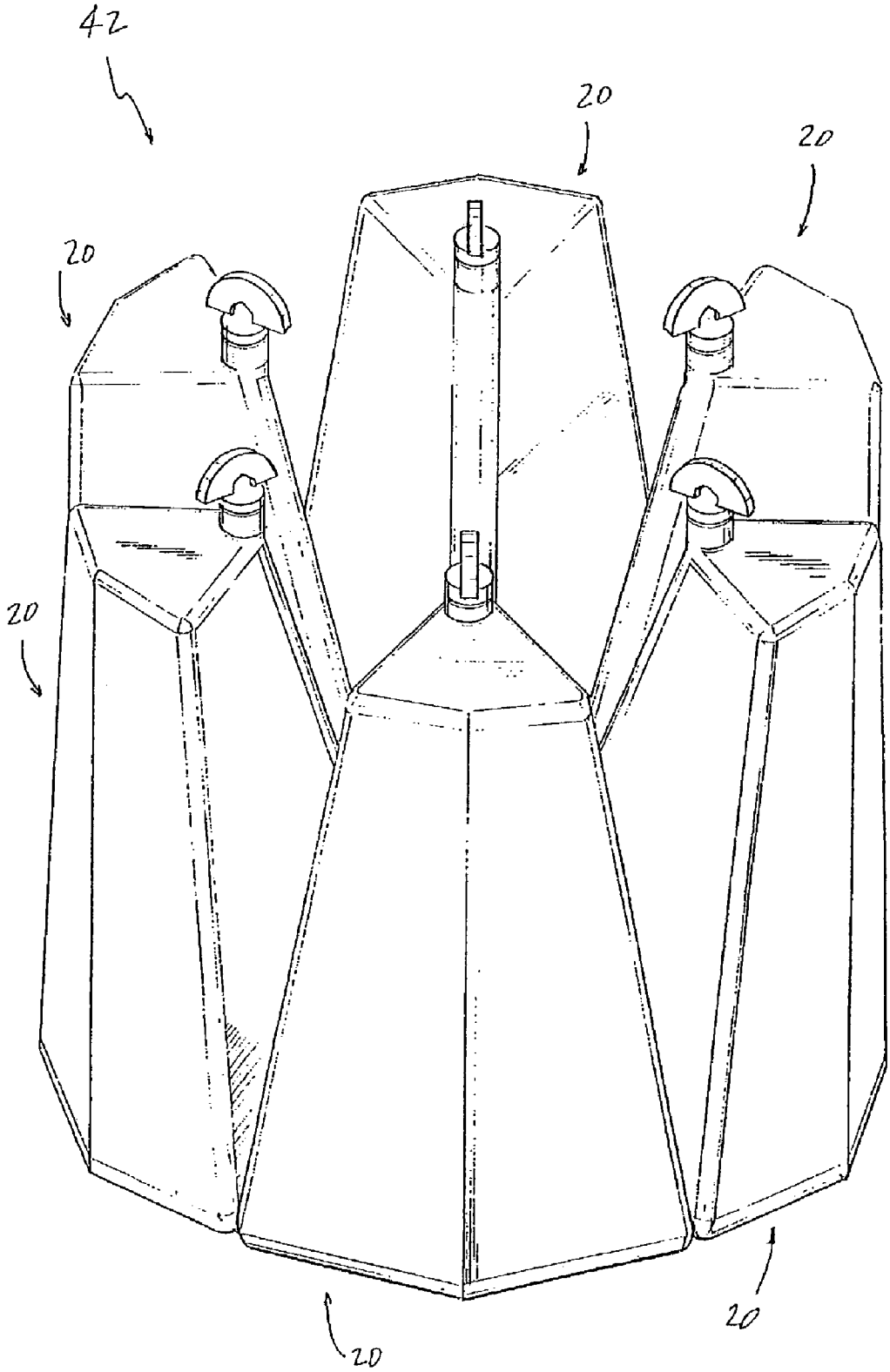
FIG. 4 is a perspective view of a six containers according to an exemplary embodiment of the present invention arranged in a hexagonal footprint.

One such wall, outer wall 24, may be generally perpendicular to the base, and accordingly this wall 24 will form an outer side of a multi-pack 44, see FIG. 4, when six or twelve containers 20 are suitably arranged. Remaining walls 26 and 28 slope toward the outer wall 24 to intersect with both it and each other, thereby forming a generally tetrahedral shape. In the particular embodiment shown, the container 20 is truncated at its top.

A slight modification may be added in order to facilitate the interleaved packaging. As shown in FIG. 3, outer wall 24 is not perfectly flat, but is bent at its middle 27 into two halves, 24*a* and 24*b*, which each form an angle of approximately 5° with a datum line 25. As seen more clearly in FIGS. 4 and 5, this angle allows the assembled multi-pack 44 to more closely resemble a cylindrical shape. This feature requires the base 22 to deviate slightly from a triangular shape to accommodate the shape of wall 24.

Walls 24, 26 and 28 enclose a chamber 30, provided to hold the contents of the container 20. A channel 32 substantially traverses the height of chamber 30, providing a means of fluid communication between the chamber 30 and the exterior of the container 20. Channel 32 may be formed integrally with the container 20 or may be a discrete component placed into and/or secured within chamber 30. As shown, the channel 32 is located along an edge of the container 20, which is to say it is adjacent a wall of the container 20. Specifically, the channel 32 is illustrated at the intersection of walls 26 and 28, opposite the outer wall 24. However, those skilled in the art will recognize that channel 32 need not be located in that particular location without departing from the scope of the invention. Channel 32 may also pass through a wall of the container 20 at any point along the height of the container 20, not merely near a top portion, as illustrated in FIGS. 1-3. Channel 32 has an opening 34 to the interior of the chamber 30 at a lower portion thereof. This allows the channel 32 to function as a straw for consuming the contents of the container 20.

At its upper terminus 36, channel 32 is provided with a suitable closure, for example, a frangible closure 38. The frangible closure 38 may be provided with a tab 40. Tab 40 allows a user to securely grip the frangible closure 38 before opening the channel 32 by tearing and/or breaking. Alternately, channel 32 may be provided with a fitment at its upper terminus 36 to seal the channel 32, yet allow subsequent opening and/or re-closing.

Figure 5:
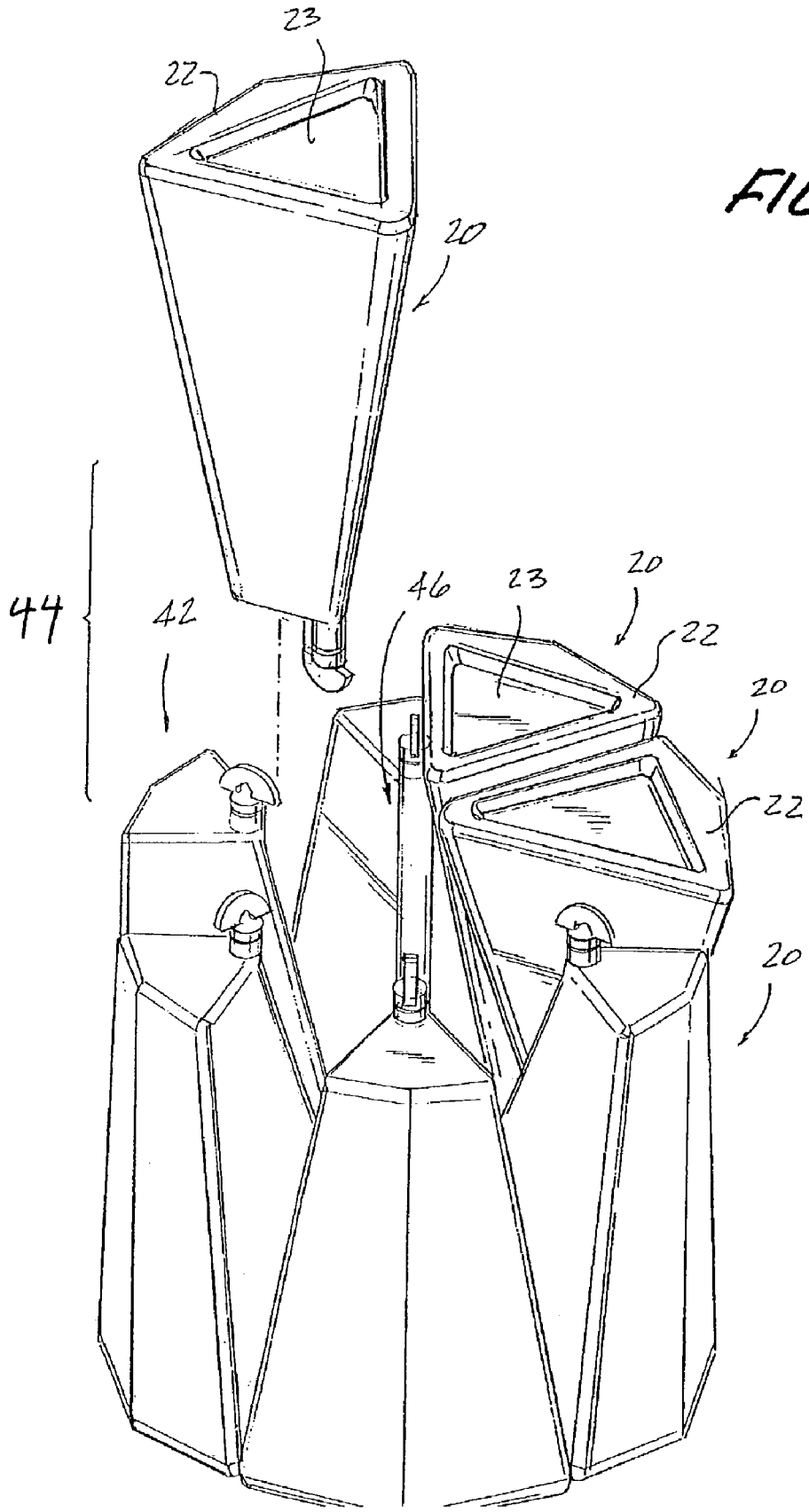
FIG. 5 is a perspective view of a several containers in an interleaved configuration according to an exemplary embodiment of the present invention.

The container 20 is dimensioned for the efficient use of space when configured in a multi-pack 44, including interleaving. With reference to FIGS. 4 and 5, six of the tetrahedral containers 20 may be arranged in a radial array, i.e., each having a similar orientation with respect to a center point, to form generally hexagonal footprint 42. Preferably, the radial array will be arranged in order that the outer wall 24 of each container 20 will face the outer perimeter of the hexagonal footprint 42. It is apparent from FIGS. 4 and 5 that the hexagonal footprint 42 closely approximates a circle, itself an efficient use of space.

When six such containers 20 are arranged in a hexagonal footprint 42, they may be inverted, and mated to six additional upright containers 20, similarly arranged in a hexagonal footprint 42. This can be accomplished by first aligning the tops of the inverted and upright containers 20, then rotating either the upright or the inverted group by one-half of one container, in this case about fifteen degrees, around the center of the hexagonal footprint 42, then bringing the inverted group together with the upright group. By virtue of the shape and arrangement of the containers 20, the peaks of the containers 20 in the one group interleave with the valleys between adjacent containers 20 of the complementary group. Accordingly, an interleaved package comprising twelve containers 20 encompasses only marginally more volume than a group of six arranged in a hexagonal footprint 42, and virtually no additional shelf area.

It will be apparent the method of assembling the multi-pack 44 described above is primarily for descriptive purposes, and is not the sole method of assembly contemplated within the scope of the invention. For example, the containers may be individually placed into a packing jig designed to support the containers in the described arrangement, and then bound together for shipment and sale. Sub-groups of containers need not be interleaved en masse. Binding can be accomplished, for example, by a shrunk wrapping or a suitable box, including corrugated and non-corrugated paperboard. Alternately or additionally, the containers may be configured to adhere to one another, either through the inherent properties of the chosen container material, or by adding an adhesive agent at any or all areas where one container meets another within the multi-pack.

Further, a relatively small void space 46 may remain in the center of the assembled multi-pack 44. This space can be put to advantageous use, for example, by carrying a promotional item or some other item of interest to the consumer.

The container 20 may be formed of a rigid material suitable for use in a beverage container as known in the art. Such rigid materials can include, but are not limited to, blow-molded polymers. The term 'rigid' is used in this context as a term of the packaging art to distinguish from semi-rigid, or pliant sheet materials, and therefore, 'rigid' comprehends some degree of flexure and resilience.

Figure 6:
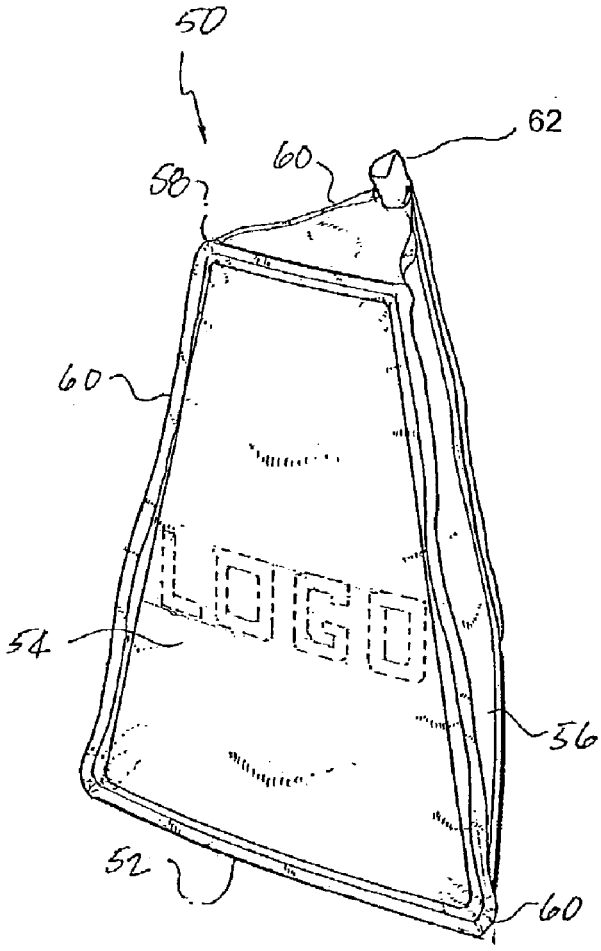
FIG. 6 is a perspective view of a single container according to an alternate embodiment of the present invention.
Figure 7:
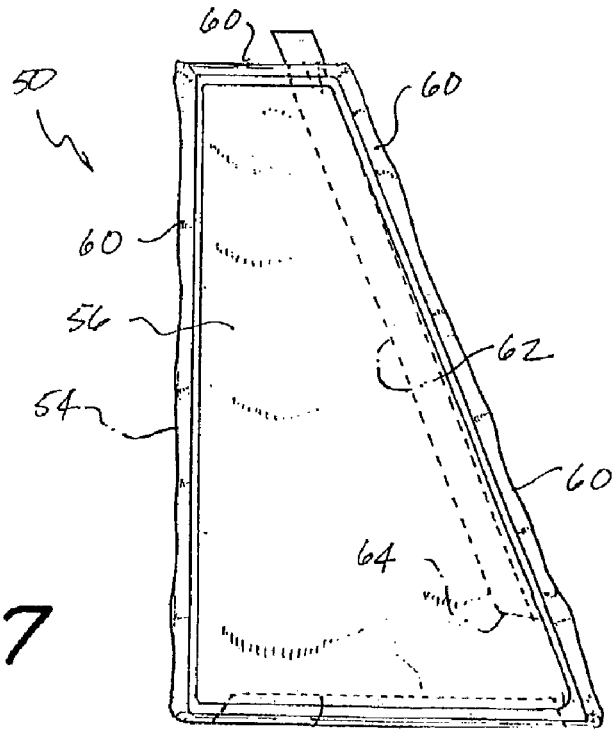
FIG. 7 is a side elevation view of a single container according to an alternate embodiment of the present invention.

With reference to FIGS. 6 and 7, in an alternate embodiment container 50 may be formed from one or more sheets of semi-rigid material such as polymer films. The film may be single ply or comprise two or more plies. One such material known in the art is a polyester film layer with an aluminum foil layer on either side. Another semi-rigid material for use in a beverage container is disclosed in co-pending U.S. patent application Ser. No. 10/078,870, filed 19 Feb. 2002 by the instant inventor and commonly owned with the instant application, which application is hereby incorporated by reference herein for all purposes. This material comprises a polypropylene film mated to a barrier layer.

Figure 8:
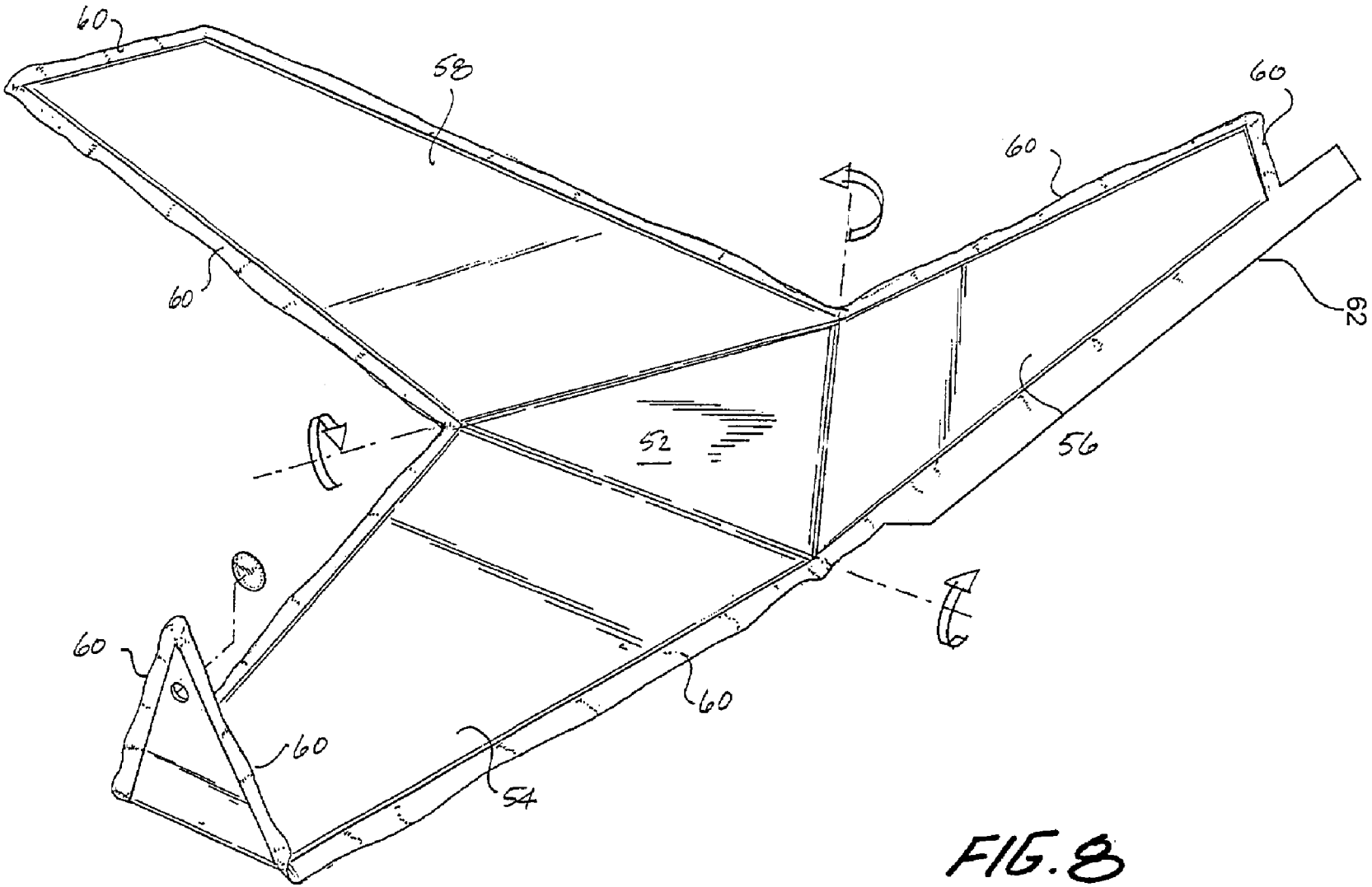
FIG. 8 illustrates an example a pattern of an unformed semi-rigid container according to an alternate embodiment of the present invention.

Semi-rigid container 50 has a base 52, and walls 54, 56, 58, enclosing a chamber 59. Each of the base and the walls can be formed from individual plies, which are be joined together at their respective intersecting edges with margins 60, for example by heat sealing or other suitable means. Alternately, the container 50 may be formed from substantially one sheet of material, cut to an appropriate pattern, thereby simplifying construction. FIG. 8 illustrates an example of a material pattern centered on the base 52. Other embodiments centered on another surface will be apparent, however. The walls 54, 56, 58 would fold up to be joined, requiring margins 60 to seal only at their intersections with each other. In this case, however, it may be desirable to nonetheless form a margin 60 at the intersection of walls 54, 56, 58 and base 52 to add stability to the walls 54, 56, 58 and the overall container 50, and/or to provide a recess 53, having the same general benefits of a recess in the previous embodiment.

In this alternate embodiment, a channel 62 can also be provided. Channel 62 has an opening 64 to the interior of the chamber 59 at a lower portion thereof. Channel 62 may be formed by a fold of the semi-rigid material, as shown in FIG. 8, or by the insertion of a discrete component, either optionally sealed to the interior of the chamber 59, for example at a margin 60.

The invention has been described herein with reference to particular exemplary embodiments. Certain alterations and modifications may be apparent to those skilled in the art, without departing from the scope of the invention. The exemplary embodiments are not meant to be limiting on the scope of the invention, which is defined by the appended claims.

The invention claimed is:

1. A fluid beverage container comprising:

a body having a generally tetrahedral shape configured for vertically interleaved packing;

a chamber within said body for holding fluid contents;

a channel for fluid communication between said chamber and the exterior of said body, said channel substantially traversing the height of said body;

a closure sealing one end of said channel; and an outer wall bent at its middle into a first half and a second half, wherein the first half and the second half of the outer wall are joined at an angle of about 175° between the first half and the second half.

2. The fluid beverage container according to claim 1 further comprising a recess formed in a base of said container.

3. The fluid beverage container according to claim 1, wherein said channel is positioned along an edge of said generally tetrahedral shape.

4. The fluid beverage container according to claim 1, wherein said generally tetrahedral shape comprises at least one wall generally perpendicular to a base of said container.

5. The fluid beverage container according to claim 4, wherein said channel is positioned along an edge opposed to said perpendicular wall.

6. The fluid beverage container according to claim 1, wherein said container is formed of a rigid material.

7. The fluid beverage container according to claim 6, wherein said rigid material comprises a blow-molded polymer.

8. The fluid beverage container according to claim 1, wherein said closure is a frangible closure.

9. The fluid beverage container according to claim 8, further comprising a tab operatively connected to said frangible closure.

10. The fluid beverage container according to claim 1, wherein said closure is a fitment.

* * * * *